US009273523B2

(12) United States Patent
McIntosh et al.

(10) Patent No.: US 9,273,523 B2
(45) Date of Patent: Mar. 1, 2016

(54) TUBULAR RUNNING DEVICE AND METHOD

(75) Inventors: Richard McIntosh, Lafayette, LA (US); Toby Scott Baudoin, Rayne, LA (US)

(73) Assignee: 2M-TEK, Inc., Scott, LA (US)

( * ) Notice: Subject to any disclaimer, the term of this patent is extended or adjusted under 35 U.S.C. 154(b) by 342 days.

(21) Appl. No.: 13/980,769

(22) PCT Filed: Jan. 19, 2012

(86) PCT No.: PCT/US2012/021820

§ 371 (c)(1),
(2), (4) Date: Jul. 19, 2013

(87) PCT Pub. No.: WO2012/100019

PCT Pub. Date: Jul. 26, 2012

(65) Prior Publication Data

US 2013/0292136 A1 Nov. 7, 2013

Related U.S. Application Data

(60) Provisional application No. 61/435,157, filed on Jan. 21, 2011.

(51) Int. Cl.
*E21B 19/18* (2006.01)
*E21B 19/06* (2006.01)

(52) U.S. Cl.
CPC ..... *E21B 19/06* (2013.01)

(58) Field of Classification Search
CPC ..... E21B 19/06; E21B 19/07; E21B 19/10; E21B 19/16
See application file for complete search history.

(56) References Cited

U.S. PATENT DOCUMENTS

| | | | | |
|---|---|---|---|---|
| 4,643,472 | A * | 2/1987 | Schukei | B66C 1/56 294/82.28 |
| 5,484,222 | A | 1/1996 | Schulze-Beckinghausen | |
| 5,967,477 | A | 10/1999 | Walmsley | |
| 6,305,649 | B1 * | 10/2001 | Walmsley | E21B 19/10 248/313 |
| 6,352,115 | B1 | 3/2002 | Mathieu | |
| 6,698,517 | B2 | 3/2004 | Simpson et al. | |
| 6,755,746 | B2 | 6/2004 | Barnley et al. | |
| 6,991,265 | B2 | 1/2006 | Welmsley et al. | |
| 7,445,050 | B2 | 11/2008 | Kuttel et al. | |
| 7,552,764 | B2 | 6/2009 | Weems et al. | |
| 7,744,140 | B2 | 6/2010 | Rowley | |
| 7,854,266 | B2 | 12/2010 | Watson | |
| 8,074,711 | B2 | 12/2011 | Ellis et al. | |

(Continued)

FOREIGN PATENT DOCUMENTS

| | | |
|---|---|---|
| IN | 0506/KOLNP/2003 | 3/2005 |
| IN | 9278/DELNP/2008 | 6/2009 |

(Continued)

*Primary Examiner* — Kenneth L Thompson
*Assistant Examiner* — Michael Wills, III
(74) *Attorney, Agent, or Firm* — Andrews Kurth LLP

(57) ABSTRACT

A method and apparatus for running tubular(s) into a well bore for use with a top drive or power swivel comprising a make-up assembly with inner and outer members, one of which has an array of ramped or inclined surface(s) while the other is an inner or outer cage with rolling support(s) with or without a central spindle and openings which may also be referred to as tubular engagement apparatus wherein relative movement of the members urges the rolling support(s) to protrude radially through the openings to engage a tubular internally or externally. Also provided is an elevator assembly with elevator links and transfer elevators to position tubular for engagement by the make-up assembly.

15 Claims, 14 Drawing Sheets

(56) References Cited

U.S. PATENT DOCUMENTS

| | | | | |
|---|---|---|---|---|
| 8,720,541 | B2 | 5/2014 | Ellis et al. | |
| 8,720,542 | B2 | 5/2014 | Hughes et al. | |
| 8,851,164 | B2 | 10/2014 | Ellis et al. | |
| 8,939,214 | B2 | 1/2015 | Litherland et al. | |
| 9,010,445 | B2 | 4/2015 | Yajure | |
| 2005/0262690 | A1 | 12/2005 | Swaffar | |
| 2008/0007056 | A1 | 1/2008 | Beesley | |
| 2009/0321064 | A1 | 12/2009 | Ellis et al. | |
| 2010/0300704 | A1* | 12/2010 | Sweeney | E21B 19/24 166/380 |
| 2011/0147010 | A1* | 6/2011 | Ellis | E21B 19/07 166/380 |
| 2014/0196909 | A1 | 7/2014 | Ellis et al. | |
| 2014/0251631 | A1 | 9/2014 | Curtiss, III | |

FOREIGN PATENT DOCUMENTS

| | | | |
|---|---|---|---|
| MX | PA05007202 | A1 | 1/2007 |
| MX | 2008013745 | A1 | 2/2009 |
| MX | 2010014527 | A1 | 2/2011 |
| MX | 2011000159 | A1 | 5/2011 |
| MX | 2011002619 | A1 | 6/2011 |
| WO | WO2009/025832 | A1 | 2/2009 |
| WO | 2012100019 | A1 | 7/2012 |
| WO | 2014164209 | A1 | 10/2014 |

* cited by examiner

PREVIOUS ATTEMPT

PREVIOUS ATTEMPT

PREVIOUS ATTEMPT

TUBULAR RUNNING DEVICE AND METHOD

BACKGROUND OF THE INVENTION

The present invention relates to a device and method for the gripping and or handling of tubular members. These tubular members vary widely in size, shape, thickness, function, orientation while in service, and industries served. They can be pipes, steel structures, columns, tubing, casing, culverts, pilings, caissons, pipelines, etc. A non-inclusive list of uses for the present invention includes:

1) A first use is in the construction of oil and gas wells where it is usually necessary to drill and line the well bore with a string of steel pipes commonly known as tubulars, casing, tubing, or generically as oil country tubular goods ("OCTG").

2) A second use is in the abandonment or decommissioning of oil and gas wells where it is usually necessary to remove the steel pipes commonly known as tubulars, casing, tubing, or generically as oil country tubular goods ("OCTG"), steel structures, pilings, caissons and or pipelines 3) A third use is in anchoring connector systems for offshore drilling establishments. In deepwater drilling activities the use of floating drilling rigs is necessary. These drilling rigs may be in the form of semi-submersibles, spars, drill ships, etc. These drilling rigs must be anchored or tethered to the sea floor to remain in position. To accomplish this, suction anchors are deployed and placed onto the sea floor. Large ropes or chains must then be attached from the drilling rig to these anchors. Anchoring connectors are used to connect the ropes or chains to the anchors via ROV's. These anchoring connectors are far easier to attach in deep water or extreme depth conditions using large shackles or the like.

4) A fourth use is in the recovery of damaged or abandoned pipelines from the sea floor. These connectors provide a means to grip the pipeline while being manipulated by a ROY.

5) A fifth use is in the placement of columns for wind energy turbines.

6) A sixth use is in the erection of structures fabricated from tubular members such as offshore platforms, water towers, etc.

While not limiting in any way the intended use of the present invention, for purposes of description the use of the present invention as it relates to a device and method for facilitating the connection of tubulars used in the oil and gas exploration and extraction industries using a top drive will be presented to illustrate the elements of the present invention. More specifically, the invention will be described as it relates to a device and method for running tubulars into and or out of a well bore.

In the construction of oil or gas wells it is usually necessary to drill and line the well bore with a string of steel pipes commonly known as tubulars, casing, tubing, or generically as oil country tubular goods ("OCTG"). For purposes of this application, such steel pipes shall hereinafter be referred to as "tubular OCTG". Because of the length of the tubular OCTG required, individual sections of tubular OCTG (tubular members) are typically progressively added to the string (tubular string) as it is lowered into or lifted out of a well from a drilling rig or platform. The section to be added or removed is restrained from falling into the well by some tubular engagement means, typically a spider or the like, and is lowered into the well to position the threaded pin of the tubular OCTG section adjacent the threaded box of the tubular OCTG in the well bore. The sections are then joined by relative rotation of the sections and the process repeated until such time as the desired total length has been achieved.

It is common practice to use a power tong to torque each connection to a predetermined torque in order to connect the sections of tubular OCTG. This traditional method and equipment types have been used extensively around the world for a period in excess of fifty years. While this method is in daily use it normally requires a large team of specialist personnel along with a plethora of equipment to successfully undertake this task. It is also a very dangerous task with personnel often having to be located on a small platform suspended up to 50 feet from the rotary table or drilling rig floor and the power tong tethered to a steel cable under high loads.

In more recent times, a top drive may be used; this is, a top drive rotational system used for drilling purposes. Where a top drive system is used to make up the connection, the use of a slip type elevator to restrain the section of tubular OCTG to be added may be problematic, due to the configuration of the top drive apparatus on the drilling platform. It is therefore known to make use of an apparatus connected to the top drive, which can be inserted into the interior of or around the exterior of a section of tubular OCTG to be added, and engaged therewith to hold the section in place. Such apparatus may comprise one or more toothed grapple/dies, which may be hydraulically operated to engage an inner or outer surface of the tubular OCTG. While this is an advancement over the traditional approach as it requires substantially less equipment, it does however have serious drawbacks in the form of potential damage it may cause to the outer or inner surface of the tubular OCTG. These grapple/dies also tend to be very sensitive to varying changes in tubular weight and diameters and therefore require a large resource of alternative sizes for each tubular OCTG size or weight to be run.

Secondly, as the grapple/dies tend to bite aggressively into the tubular OCTG and take no account of alignment issues it is possible to load one side of the grapple/dies while running the tubular OCTG into the well bore. The possibility of loading one side of the tubular OCTG can present serious consequences for the integrity of the tubular OCTG and its ability to withstand down-hole pressures in the borehole. This in turn may also result in premature failure of the grapple/dies or impede their ability to act correctly on the tubular OCTG.

Thirdly, as the grapple/dies tend to be suspended on the outside of the member for internal gripping tools with no means of constraint they can become a huge safety issue if the rotational drive is engaged whilst the probe is not inside the tubular OCTG. The centrifugal forces cause the grapple/dies to separate from the tool member, causing them to become entangled in the steel framework of the rig and potentially becoming dangerous objects falling from the derrick structure.

Fourthly, traditional methods of tool design permits the slip assemblies, bodies or inserts to potentially friction bond or become adhered to each other under heavy load conditions. This factor is due to the static frictional forces increasing; thereby displacing the lubricants between the sliding member surfaces. If these slip assemblies, bodies or inserts become frictionally adhered, this can cause serious problems, especially in a well control situation. It can cause the tubular OCTG or the slip assemblies, bodies or inserts to require to be mechanically separated by means of a cutting torch or other means.

Lastly in more recent designs the grapple/dies portion has been replaced by the adoption of ball and taper or rolling element and taper technology originally designed for anchor handling applications where a static or dynamic axial load is applied. In order to better understand the terminology and advantages of the present invention the definitions of a ball and rolling support are:

Ball—shape in which all surfaces are equidistant from its centroid with no limitation of rotation in any given plane or direction Rolling Support—shape in which all surfaces are not equidistant from its centroid but with constraints can function as a rolling support in one plane or direction. The surfaces can be multi-faceted and or can be geometrically altered to fit a given profile with the ability to bear, hold, or support a load, mass, structure or part thereof In mooring applications for offshore floating structures chain is widely used, usually as part of a system combining chain and rope, be it fiber or wire. Multiple connectors and chain are favored for mooring systems for several reasons:

It is rugged and less prone to damage than wire or fiber rope when used with topsides, catenary, or seabed equipment. It is also easy to handle and requires only standard topsides tensioning equipment It is less prone to corrosion than wire rope Chain weight per unit length is higher than wire rope for a given strength. So chain can be used mid-line as a clump weight to alter the catenary shape or as a ground line so that a smaller anchoring system can be used.

While this method of multiple connectors or anchor stations has been successful in mooring connectors where a failure of one connector will most likely not have a serious impact on the other connectors and repairs can be expedited. Design safety factors for mooring connectors and or mooring chains are substantially lower than the International Standard ISO 13535 for Petroleum and natural gas industries—Drilling and production equipment—Hoisting equipment. When it comes to handling tubulars OCTG's where a single connector is used the failure of this single connector has the potential for catastrophic consequences.

A first disadvantage of previous attempts is in the design of the member containing the inclined or tapered ramps which include areas of deeper than necessary pockets as well as sharp corners. These pockets are used for assembly purposes in some previous attempts and for locating spring biasing devices in others. These pockets decrease the minimum cross sectional area. The minimum cross sectional area of the member containing the inclined ramps is a critical factor in determining the Safe Working Load rating and or capabilities for the gripping device. The International standard ISO 13535 for Petroleum and natural gas industries—Drilling and production equipment—Hoisting equipment requires that all hoisting equipment furnished under this International Standard shall be rated in accordance with a specific load rating based on the design safety factor. This is especially important for internal gripping devices where the device outside diameter is dictated by the internal diameter of the tubular OCTG to be run or pulled. Thus, the main cross sectional area of the load bearing member is vitally important and must be maximized by all means possible.

The design safety factor is specified as a multiplication formula for hoisting equipment whereby the specified minimum yield strength of the materials chosen must be tested between two and a quarter (2¼) and three (3) times the safe working load, then checked for functionality, fit and fully inspected for signs of failure. Thus, it is evident that in order to comply with the Safe Working Load Rating and Design Safety Factors hoisting tools must have the cross sectional area maximized to achieve the high load carrying capacities required of them.

A second disadvantage of previous attempts is that they were ineffective in providing the rotational torque capacity required for the make-up or break-out of said tubular OCTG. This is due to the self-engaging, spring biased, or gravity biased balls or rolling elements of current designs. Some embodiments of previous attempts utilize springs on individual balls or rolling elements to urge them down the inclined surface toward the shallow end causing them to protrude from the cage. This method of energizing the balls or rolling elements is ineffective in applying an adequate amount of preload force on the balls or rolling elements to create an indentation of sufficient size and depth to apply the required torque without slipping. These designs do not allow the operator the ability to hydraulically, pneumatically, or mechanically control these preload forces to create the required indentations for applying torque.

A third disadvantage of this previous attempts is in the design of the openings or slots and its role in applying torque. Previous attempts cage housing openings make no attempt to aid in the application of torque. It will be shown in the accompanying drawings that the design of the cage housing openings of the invention presented here make accommodations for aiding in the transmission of torque. The cage housing openings contain large surface areas on the flat sides to contact against the sides of the rolling supports for torque transmission. This cage housing can also be splined, keyed, or otherwise affixed to the member containing the inclined surfaces to allow relative axial movement while disallowing relative rotational movement. This feature allows torque to be transmitted from the member having the inclined surfaces, through the cage and rolling supports, to the tubular.

A fourth disadvantage of this previous attempts is the use of elongated slots where the length of the slot is substantially longer than the diameter of the ball or rolling element. When disengaging a gripping device utilizing these elongated slots, the cage housing must travel axially an excessive distance before the slot comes into contact with the ball or rolling element then must continue to travel axially to urge the ball or rolling elements up the inclined surface toward the deep end of the pocket and thus released position.

A fifth disadvantage of these elongated slots is the large cavity created between the elongated slots and the inclined surfaces. This cavity may become filled with debris or other materials than can inhibit or prevent the function of the gripping device.

A sixth disadvantage of the elongated slot design is that the slot must contain a means of retaining the ball or rolling element along the longer sides of the slot because the ball or rolling element must be allowed to travel the entire length of the slot. This is generally accomplished by having the width of the slot narrower than the diameter or width of the ball or rolling element. This aspect of the design prevents the sides or edges of a rolling element to protrude from the cage housing which limits the options for the shape of the rolling element. It is important to have the ability to change or modify the shape of the rolling elements to accommodate varying applications. The shape of the rolling element can also limit the range of outer or inner surface diameters which can be gripped with a given gripping device configuration.

A seventh disadvantage of the elongated slots is amount of material that is removed from the cage housing diminishing the structural integrity of the cage housing. Tools and equipment manufactured for service on a drilling rig must be very robust as they operate in extreme conditions. Transporting tools to or from a drilling rig, loading, and unloading of these tools, especially on an offshore location, as well as handling of these tools can create damages. Thus tool designs must account for these conditions of service.

A eighth disadvantage of previous attempts is the means of disengaging or releasing an internal gripping device during entry into a tubular whereby frictional forces acting upon the outer surface of the cage housing imposed from the internal surface of the tubular act to urge the cage housing in a direction such that the rolling elements move toward the deep end of the inclined surfaces, thus released position. This previous attempts design requires these frictional forces to function properly. This "dragging" of the cage housing produces wear on the cage housing as well as the internal surface of the tubular. This dragging can also cause damage to the internal tubular threads. Again, it will be evident from the accompanying drawings and descriptions that the present invention is superior in that it provides a hydraulic, pneumatic, or mechanical means of retracting or releasing the gripping device prior to entering a tubular. It is also a feature of this invention that the rolling supports are not allowed to fully retract into the cage housing. In a fully retracted position, the rolling supports remain partially protruded from the cage housing. This allows the rolling supports to act as rolling bearings between the cage housing and tubular surface aiding in the entering and or exiting of a tubular.

A ninth disadvantage of previous attempts is in the design of the member containing the inclined or tapered ramps which include areas of deeper than necessary pockets as well as sharp corners. It is known that sharp edges or corners should be eliminated where possible to remove stress concentration areas as well as areas increasing the potential for cracking. These sharp corners also create areas prone to corrosion and or rusting.

A tenth disadvantage of previous attempts is in the use of multiple components such as small springs, plungers, inserts, biasing devices, etc which are all made unnecessary by the embodiments of the present invention. All of these components must be held in place via means such as press fitting, adhesives, threaded fasteners, etc. which all initiate the potential for failures. It is well known that as the number of parts is increased for a single mechanical device so does the odds of failure. The corresponding machining or manufacturing processes for these components is greatly complicated by the use of these components. The complexity and tight tolerances required to successfully manufacture these components substantially increases the overall cost of the gripping device.

An eleventh disadvantage of previous attempts again in the use of multiple components such as small springs, plungers, inserts, biasing devices, etc is that should any of these small components become loose or free from constraint, they can potentially fall into the wellbore. This potential is very high due to the jarring and shock loads the gripping device will experience in service as well as transport. These shock loads can loosen threaded fasteners or other means of retention. Also, heat and or extreme cold can affect retention means such as adhesives, press fit and interference fit tolerances. Should any of these components become free from constraint, the elongated slots will allow these items to depart from the assembly, thereby becoming major safety hazards with the potential for serious damage to personnel or structures from flying debris. Materials or items which unintentionally fall into the wellbore create an array of very costly problems.

A twelfth disadvantage of the previous attempts utilizing the aforementioned inserts which are press fit or otherwise attached to the member containing the inclined surfaces is in the non destructive testing of these components after each use in the field.

It is well known in the oilfield industry that after each use, all load carrying tools must be completely disassembled, cleaned, and inspected for cracks, wear, damages, or anything else that may prevent a tool from functioning properly or possibly failing in service. Components which are press fit or adhered using adhesives are generally very difficult or impossible to remove for inspection purposes. This means that these parts will likely not be removed thereby possibly hiding a crack or damage. If a threaded fastener is used, these threads create stress risers and areas for corrosion to begin.

The intention of the present invention is to offer a much improved apparatus and method of running tubular OCTG into or out of a borehole vastly improving the safety, efficiency and torque capability without the shortfalls in the tools available today.

SUMMARY OF THE INVENTION

A device and method has been invented for gripping and or handling tubular members. For purposes of clarity, the embodiment of the present invention as it relates to the handling of OCTG will be described. The inventive device is connectable to a top drive and can be used to grip the tubular OCTG from the inside or the outside. The system comprises a top drive, a tubular OCTG running assembly, elevator links, transfer elevators, tubular sealing element, and mud valve.

The operator can remotely manipulate the elevator links to extend or retract the transfer elevators to pick up and position a tubular OCTG above the tubular OCTG already secured in the rotary table on the drill floor. This function is normally achieved using a manually operated single joint elevator; however the present invention has incorporated a hydraulic transfer elevator complete with safety interlock thereby reducing the need to manually position or function the transfer elevator making the operation much safer and more operationally efficient. The operator can then engage a probe and activate a hydraulic or pneumatic actuator causing the inventive gripper assembly to grip the tubular OCTG, and then use the rotational capability of the top drive to remotely couple the two joints of tubular OCTG together.

According to a first aspect of the present invention, there is provided a tubular OCTG running assembly for running tubular OCTG into and/or out of the well bore, the assembly comprising a probe engageable within the tubular OCTG, wherein the probe comprises an inner member having an outer surface with a plurality of ramped or inclined surfaces and an outer cage surrounding the inner member having a plurality of openings to captively constrain rolling supports with or without a central spindle. The openings of the outer member are aligned with the ramped or inclined surfaces of the inner member and are axially movable to cause the rolling supports with or without a central spindle to climb and descend the ramped or inclined surfaces thus, respectively to retract within and protrude from said openings and, when protruding, to bear upon the inner surface of the tubular OCTG to lock the probe and receiving tubular OCTG in engagement.

According to a second aspect of the present invention, there is provided a tubular OCTG running assembly for running tubular OCTG into and/or out of the well bore, the assembly comprising a housing assembly engageable with the external surface of the tubular OCTG, wherein the housing assembly comprises an outer member having an inner surface with a plurality of ramped or inclined surfaces and a cage within the outer member having a plurality of openings to captively constrain the rolling supports with or without a central spindle. The openings of the inner member are aligned with the ramped or inclined surfaces of the outer member and are axially movable to cause the rolling supports with or without a central spindle to climb and descend the ramped or inclined surfaces thus, respectively to protrude from and retract within said openings and, when protruding, to bear upon the outer surface of the tubular OCTG to lock the probe and receiving tubular OCTG in engagement.

The probe or external latching assembly farther comprises a hydraulic, pneumatic or mechanical actuator having a sleeve that is in connectable engagement with the cage housing (member with the openings), and when activated, will cause the cage housing to travel axially relative to the movement of the member with the ramped or inclined surfaces, thus providing a means of controlling the placement of the rolling supports with or without a central spindle relative to the ramped or inclined surfaces, therein locking or unlocking the probe or external latching assembly in place prior to applying a rotational force, lifting action or lowering action or both upon the tubular OCTG. The contact forces between the rolling supports with or without a central spindle and the surface of the tubular OCTG can be controlled such that necessary indentations are produced on the tubular OCTG to provide for the required torque value.

The surface of the rolling supports with or without a central spindle can be hemispherical or can be of any other surface profile such as nodular, sinusoidal, waveform, etc. The surface finish or texture can be smooth, coated with a grit type material, toothed such as conventional inserts (could possibly look like a carbide burr), or a combination of these. The hemisphere profiles could be shaped so that they extend beyond the cage housing more than the hemispheric diameter as is with current ball and taper technology which is extremely limited. They can extend out any desired distance allowing the tool to work for a larger range of sizes and or weights.

One major advantage of this method of engagement of the rolling supports with or without a central spindle against the tubular OCTG is that this method provides for maximum displacement of load without causing damage to the inner surface of the tubular OCTG. Damage to or scarring of the inner or outer face of the tubular OCTG can cause premature failure of the tubular OCTG resulting in the requirement to undertake expensive remediation work on the well bore. Standard dies, grapple/dies, inserts, etc. tend to scar the tubulars in both longitudinal and circumferential directions, placing stress concentration areas as well as crevices for corrosion to take place. The advantage of the rolling supports with or without a central spindle engagement mechanism is that they produce smooth indentations which do not create areas of increased corrosion or stress concentrations. The areas of indentation are actually work hardened thus they are mechanically stronger than the remaining tubular material. Thus, this means of engagement enhances the mechanical properties of the tubular rather than degrading the mechanical properties.

According to a third aspect of the present invention, there is provided a remotely operated elevator assembly for facilitating the transfer of a tubular OCTG from the V-door of a drilling rig to the vertical position and thereby allowing the tubular OCTG to be stabbed into a similar tubular OCTG located in the slip assembly located in or on the drill floor for the running or pulling of tubular OCTG into and/or out of the well bore. The elevator assembly comprises a set of telescoping transfer elevator links attached to the tubular running assembly of the present invention connected to the top drive system or drilling hook on a non-top-drive fitted rig, whereby the telescoping transfer elevator links can be extended to facilitate engagement of the tubular OCTG at the V-door and then retracted to bring the tubular OCTG into a position to be raised to a position ready for stabbing of the tubular OCTG into a similar tubular OCTG located in the slip assembly located in or on the drill floor. The elevator assembly may also have an elevator link tilt assembly comprising two or more hydraulic actuators, wherein the link tilt assembly is coupled to the telescoping transfer elevator links such that the extension or retraction of the hydraulic actuators can pivot the telescoping transfer elevator links about a point located on a horizontal axis; providing a secondary means of positioning the transfer elevators to facilitate transfer of the tubular OCTG into the stabbing position for make-up.

The tubular running assembly may further be provided with a positive locking means to maintain the rolling supports with or without a central spindle in engagement with a tubular OCTG should the make-up assembly otherwise fail. The positive locking means may be provided in conjunction with axially angled faces, and/or in conjunction with circumferentially angled faces. The positive locking means may comprise, for example, a spring or hydraulic safety interlock system.

In addition to gripping, rotating, anchoring, lifting and lower the tubular OCTG, another function of the tubular running assembly is to transmit the circulation of drilling fluid or mud through the tubular OCTG. In order to pump drilling fluids or mud, a seal must be established between the tubular OCTG and the tubular running assembly of the present invention. In use, the tubular running assembly will be connected to a top drive via a threaded connection at its upper end, or to a non-top-drive rig via a pup joint latched into an elevator. Both systems have available a means of connecting to a circulating system that will permit the tubular being handled to be filled or circulated at any time during the running operation. In preferred embodiments, the members of the tubular running assembly are equipped with a through bore to permit tubular fill-up and circulation to take place at any time.

There may also be provided a packer cup with a sealing element, preferably comprising an elastomeric element or layer over a steel body. The sealing element of the packer cup is self energizing or pressure activated through a port or chamber located in the inner mandrel, which forces the sealing element against the walls of the tubular OCTG, thereby forming a seal to allow mud or drilling fluid to be pumped through the tubular OCTG assembly.

The present invention further comprises a wireless communication control system that is able to manipulate the telescoping transfer elevator links, link tilts, and other elements of all aspects of the present invention. The control system of the present invention is able to open and close the transfer elevators, retract and extend the telescoping transfer elevator links, the secondary link tilt, control and measure the application of torque and turns and may also stop the rotation of the make-up assembly of the present invention at a pre-determined torque point utilizing either a wireless communication safety system or a system of hydraulic or pneumatic control line umbilicals. The wireless communication safety control system can also be used in other applications to measure and control torque, applied loads such as string weight and/or have the ability to dump torque or applied load at a predetermined point. The wireless communication safety system may also be coupled conventionally using a series of cables should the use of wireless communication be restricted.

The safety control system is also able to set and unset the hydraulic actuator used to hydraulically manipulate the cage housing of the tubular engagement apparatus causing the rolling supports with or without a central spindle to contact the tubular OCTG to facilitate handling and make-up or breakout of the tubular OCTG threaded connection. The safety control system is also able to monitor feedback loops that include sensors or monitors on the elements of the present invention. For example, sensors of the safety control system of the present invention monitor the open and close status of the transfer elevator, the status of the hydraulic, pneumatic and or mechanical actuator and thereby the position of the rolling supports with or without a central spindle. The safety control system is design rated and or certified for use in a hazardous working environment. Communication with the processor of the safety control system can be accomplished through a wireless communications link.

The tubular running assembly may further comprise a lower member with a ramp or inclined surface guide shoe or a bull-nose centralizer with a ramp or inclined surface high density urethane, polymer coated, or composite section sized to suit the tubular OCTG being run, to facilitate easy stabbing of the apparatus into the tubular OCTG, attached to the bottom of the inner member to further protect the thread and sealing areas of the tubular OCTG to be coupled together. The lower member farther comprises a valve to prevent mud discharge onto the drill floor when the mud pumps are disengaged and the apparatus is removed from the tubular OCTG. The lower member can also be fitted with singular or multiple two-way acting check valves to facilitate reverse circulation or a solid member if necessary.

It is an object of this invention to provide a tubular running assembly for connection to a top drive for running individual or multiple tubular OCTG into and/or out of a well bore, and allowing the operator to make-up or breakout a tubular OCTG, wherein the tubular engagement apparatus comprises a series of inner and outer members or housings, one of which has an array of ramped surfaces while the other comprises a series of openings, with a plurality of rolling supports with or without a central spindle captively located between the inner and outer members, wherein relative axial movement of the members or cage housing acts to urge the rolling supports with or without a central spindle to protrude radially through the openings in the cage housing thus engaging the tubular OCTG. It is further intended that the gripping principal may be used for internal or external gripping. It is further intended that the rolling supports with or without a central spindle and their respective ramped or inclined surfaces may be disposed randomly about the tubular engagement apparatus or in longitudinally spaced rows where the rolling supports with or without a central spindle of each row are offset laterally with respect to those of the next succeeding row.

It is a further object of this invention to provide a tubular running assembly for handling a tubular member, making up or breaking out of threaded connections between the tubular member and another tubular member or tubular string, and the handling of the tubular string into or out of a wellbore, comprising a tubular engagement apparatus connectable to the driveshaft of a top drive, power swivel, or the like, the tubular engagement apparatus having rolling supports with or without a central spindle and a ramped or inclined surface assembly and an actuator wherein the rolling supports assembly consist of inner and outer members, one member containing an array of ramped or inclined surfaces while the other member comprises a tube with a plurality of openings which retain the rolling supports with or without a central spindle; wherein relative axial movement between the inner and outer members of the rolling supports with or without a central spindle acts to urge the rolling supports with or without a central spindle up or down the ramped or inclined surfaces to radially protrude or retract rolling supports with or without a central spindle through the openings in the tube member, thus engaging or disengaging the tubular member; wherein the tubular engagement apparatus is energized and de-energized by powered mechanical means provided by the hydraulic, pneumatic, mechanical or the like actuator, whereby the rolling supports with or without a central spindle are forced up or down the ramped or inclined surfaces of the drive member thereby causing the rolling supports with or without a central spindle to come into contact with or retract from the surface of the tubular member; and wherein rotation of the driveshaft of a top drive, power swivel, or the like produces a corresponding rotation in the tubular member or tubular string via engagement of the rolling supports, whereby there is minimal relative rotation between the tubular engagement assembly and the tubular member or tubular string.

The inventive tubular running assembly may also be connected to a power swivel or suspended under a traditional Kelly in the event that the drilling rig does not have a top drive installed and/or on a hydraulic work-over rig or snubbing unit. In the latter application the power swivel may be installed into a hydraulic or pneumatically controlled frame to lift and lower the power swivel and tubular running assembly of the present invention into and out of the tubular OCTG and thereby the well bore.

It is a further object of this invention that the tubular running assembly comprise a hydraulic, pneumatic, mechanical or the like actuator, that when energized will cause the cage housing to travel axially relative to the movement of the member with the ramped or inclined surfaces thus providing a means of controlling the placement of the rolling supports with or without a central spindle relative to the member containing the ramped or inclined surfaces therein locking the probe in place prior or external latching assembly to applying a rotational force, lifting or lowering action upon the tubular OCTG.

It is further intended that the tubular running assembly be provided with a through bore to allow the transmission of drilling fluids or mud for the purpose of filling or circulation of the tubular OCTG while running into the well bore and further comprise a lower packer cup on the lower member section of the make-up assembly which is self energizing or pressure activated through a port or chamber located in the inner mandrel thereby forming a seal to allow drilling fluid or mud to be pumped into the tubular OCTG and/or well bore.

It is an object of this invention that the tubular running assembly further comprise an elevator assembly with elevator links and transfer elevators which can be remotely manipulated to extend or retract the transfer elevators to pick up and position a tubular OCTG above the tubular OCTG already secured in the rotary table on the drill floor wherein the operator can then engage the make-up assembly to energize the rolling supports and use the rotational capability of the top drive to remotely couple the two tubular OCTG together.

It is a further object of this invention that the elevator assembly comprise a set of links used to position the tubular OCTG from a mostly horizontal position to the vertical position wherein said links each contain a single and or multi stage hydraulic or pneumatic cylinder contained within the body of the links or mounted externally allowing the operator to extend the links into the correct position to accept the tubular OCTG in the transfer or lifting elevators.

It is a further object of this invention that the hydraulic or pneumatic cylinders may be coupled to a weight compensation control system whereby the activation of the weight compensation system will provide for the tubular OCTG to be lowered in a controlled fashion into the tubular OCTG already secured in the rotary table on the drill floor and utilizing the weight compensation system will effectively give the tubular OCTG zero weight in gravity and protect the threads of the tubular OCTG during stabbing operations, for make-up or breakout operations.

It is a further object of this invention that the weight compensation control system can be a separate system installed above the tubular running assembly actuator and below the top drive whereby the activation of the weight compensation system will provide for the tubular OCTG to be lowered in a controlled fashion into the tubular OCTG already secured in the rotary table on the drill floor and utilizing the weight compensation system will effectively give the tubular OCTG zero weight in gravity and protect the threads of the tubular OCTG during stabbing operations, for make-up or breakout operations.

It is a further object of the invention to provide a method of running tubular OCTG into and/or out of a well bore, comprising the steps of: locating a tubular OCTG and extending links and transfer elevators around the tubular OCTG; latching transfer elevator around tubular OCTG; moving a top drive with a tubular running assembly in an upward movement causing the captured or retained tubular OCTG into a vertical position above a tubular OCTG already secured in the rotary table on the drill floor; activation of the weight compensation system to lower the tubular OCTG in a controlled fashion into the aforementioned tubular OCTG already secured in the rotary table; engage the threads of the upper tubular OCTG in the threads of the tubular OCTG already secured in the rotary table on the drill floor; activate the hydraulic, pneumatic, mechanical or the like actuator, into the release position producing relative movement of the members causing the rolling supports with or without a central spindle to retract radially through openings in the tube; lowering the tubular running assembly onto or into the tubular OCTG; activate the hydraulic, pneumatic, mechanical or the like actuator into the latch position producing relative movement of the members causing the rolling supports with or without a central spindle to protrude radially through openings in the tube; once the rolling supports with or without a central spindle are engaged on the inner or outer wall of the tubular OCTG, rotate the top drive mechanism to cause the upper tubular OCTG threads to engage correctly with the mating threads of the tubular OCTG already secured in the rotary table on the drill floor and thereby connecting both tubular OCTG into one continuous member; lifting the tubular OCTG members in an upward direction by the tubular running assembly connected to the top drive while unsetting the slip mechanism of the retaining device in the rotary table to allow the joined tubular OCTG to be lowered into the well bore. By reversing the process the tubular OCTG members can be removed from a well bore if desired.

It is further intended that the surface of rolling supports with or without a central spindle may be: smooth, smooth and hardened, coated with a grit type material, toothed such as conventional inserts and dies, toothed and grit coated, or a multitude or combination thereof. The rolling supports with or without a central spindle block surface may be of any shape or profile including: smooth, curved, flat, hemispherical, nodular, lumpy, sinusoidal, waveform, etc., and any combination thereof. The hemispheres or other surface profiles on the rolling supports with or without a central spindle can either be smooth, coated with a grit type material, can include some type of tooth profile such as conventional dies, or any combination thereof. The hemispherical profiles of the rolling supports with or without a central spindle can be shaped so that they extend beyond the tube member more than is possible with current ball and taper technology. They can extend out any desired distance, thereby allowing the tool to work for a larger range of sizes and or weights. The backing surfaces and cage provide far more contact surface area between the rolling supports with or without a central spindle backing surface and member ramped or inclined surface ramp than balls. The rolling supports with or without a central spindle also provide more surface area on their edges for the application of torque than do balls. Again, balls create a point loading on the sides of the ramped or inclined surface slots on the member with the potential for indentation. The rolling supports with or without a central spindle greatly reduce this potential for member damage. The surfaces of the rolling supports with or without a central spindle and or the sliding mating surface of the member can be coated with a friction reduction material, plating or process such as Teflon, Xylan, plain bearing or self lubricating materials such as an acetal filled bronze, chrome plating, hard chrome plating, electroless nickel, etc. The rolling supports are constrained within a housing, such that they cannot be removed without complete disassembly of the tool. This becomes important should the assembly be rotated in free space (such as above a rig floor in the derrick), the rolling supports with or without a central spindle cannot become projectiles. The rolling supports with or without a central spindle technology including the hemispherical or nodular surface features may also be used as inserts, dies or grapple/dies for other tubular running or gripping tools such as tongs, spiders, elevators, hand-slips safety clamps, fishing tools, sub surface tools, whipstocks or packer type assemblies etc.

BRIEF DESCRIPTION OF THE DRAWINGS

These and other aspects of the present invention will now be described by way of example only and with reference to the accompanying drawings, in which.

DETAILED DESCRIPTION OF THE INVENTION

In FIGS. 1-2 and 6 through 51 is shown a series of embodiments of a tubular engagement apparatus comprising a first member having a plurality of ramped or inclined surfaces, a second member(s) having a plurality of openings, and a plurality of rolling supports with or without a central spindle mounted upon and aligned with the inclined surfaces of the first member. These rolling supports are constrained by the second member(s) while allowing the rolling supports to travel up or down the ramped or inclined surfaces. This tubular engagement apparatus can be configured to grip the interior or exterior surface of a tubular as shown in FIG. 1 and FIG. 2 respectively.

Figure 1:
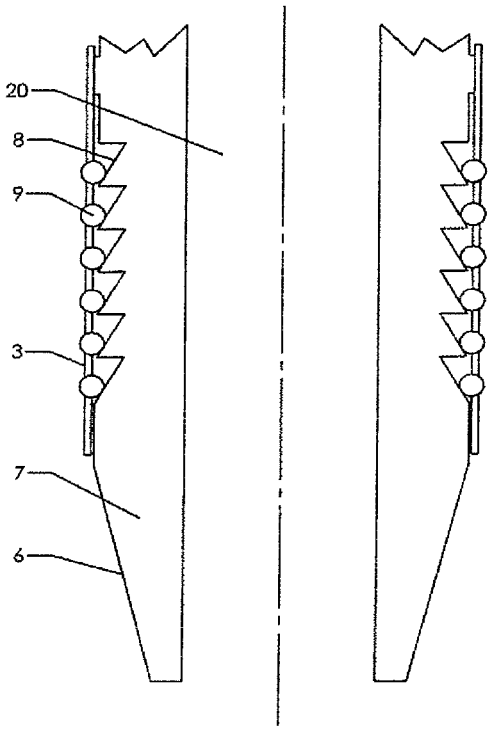
FIG. 1 shows an axially sectioned view of the rolling supports with or without a central spindle and inclined surface assembly for gripping the internal surface of a tubular OCTG.
Figure 2:
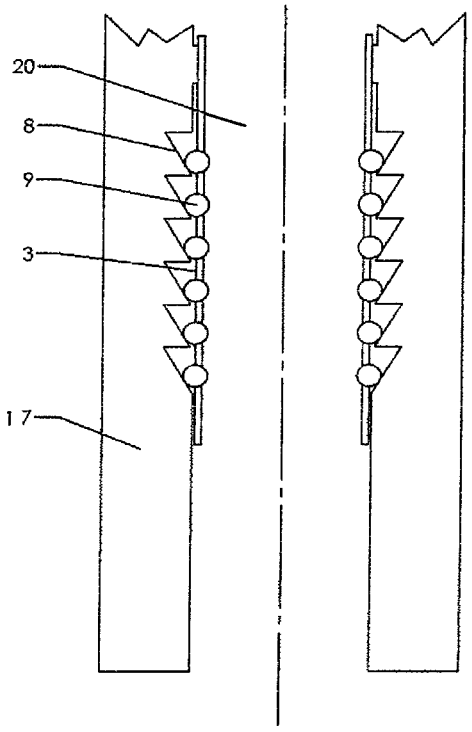
FIG. 2 shows an axially sectioned view of the rolling supports with or without a central spindle and inclined surface assembly for gripping the external surface of a tubular OCTG.
Figure 6:
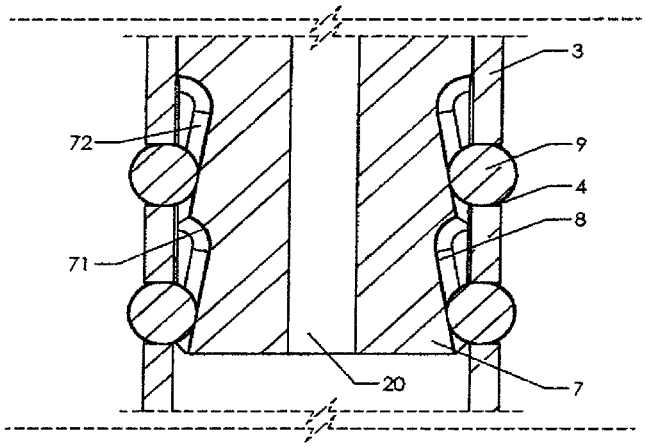
FIG. 6 shows an axially sectioned view of a rolling supports with or without a central spindle and inclined surface assembly according to the invention for gripping the internal surface of a tubular OCTG displaying the inclined surface profile used to urge the rolling supports with or without a central spindle against the inner wall of a tubular OCTG.

The tubular engagement apparatus configured to grip the interior of a tubular comprises an inner tubular member 7 shown in FIG. 1 and FIG. 6 having a plurality of ramped or inclined surfaces 8 spaced apart thereon, a second elongate outer cage member 3 superimposed with respect to the ramped surfaces 8 of the inner member 7, a plurality of rolling supports with or without a central spindle 9 captively retained within openings 4 of the cage 3 so as to reside respectively on the ramped surfaces 8 of the inner member 7. Energizing a hydraulic, pneumatic, mechanical or like actuator 2 will cause relative movement of the outer cage 3 with respect to the inner member 7 to cause the rolling supports with or without a central spindle to ascend or descend the ramped or inclined surface 8 of the inner member 7 thereby protruding from or retracting within openings 4. These openings can be arranged in various styles about or around the outer cage 3. As the rolling members 9 protrude from the openings 4, they come into contact with the interior surface of tubular 10. Sufficient force is applied to the outer cage 3 via the actuator 2 to urge the rolling supports with or without a central spindle 9 down the ramped or inclined surfaces 8 of inner member 7 causing contact with the interior surface of the tubular. The contact forces between the rolling supports with or without a central spindle 9 and the interior surface of the tubular are sufficient to create an indentation. The size of this indentation can be calculated and carefully controlled by means of controlling the forces generated by the actuator 2. The size of this indentation and thus the necessary output forces of the actuator 2 are predetermined to provide the torque capability necessary to make up or break out a tubular connection with the proper torque values. Once the indentations are created, a rotational movement can be applied by the top drive to connect a tubular to its respective partner located in the rotary table. In addition the inner member 7 has a through bore 20 shown in FIG. 6 formed through its longitudinal axis for the purpose of allowing conveyance of drilling fluids or mud.

The inner member 7 may be of circular cross section having the outer cage 3 concentrically disposed around it.

The inner member 7 and the cage 3 may be arranged for longitudinal movement one with respect to the other.

The inner member 7 and the outer cage 3 may be splined or keyed to one another thereby allowing longitudinal relative movement but disallowing rotational movement there between.

The cage may be an outer cage 3 having an array of openings 4, through which the respective rolling supports with or without a central spindle 9 may partially protrude. The cage is substantially a tube, but may also be split into two or more parts or may be manufactured in more than one component, plate, etc. for assembly purposes.

The tubular engagement apparatus can also be configured to grip the exterior surface of a tubular. This exterior tubular engagement apparatus operates just as the aforementioned internal tubular engagement apparatus but is configured such that the cage member and the inclined surfaces are on the interior of the tubular engagement apparatus.

An embodiment of the present invention will now be described, by way of example only with reference to the accompanying drawings numbered as FIG. 1 through to 51.

FIG. 1 is a sectioned view illustrating the relationship and orientation of the rolling supports with or without a central spindle 9, the inner member 7, cage housing 3, internal bore 20, ramped or inclined surfaces 8, and nose cone 6 for an internal gripping tubular engagement apparatus.

FIG. 2 is a sectioned view illustrating the relationship and orientation of the rolling supports with or without a central spindle 9, outer member 17, cage housing 3, internal bore 20, and inclined ramps 8 for an external gripping tubular engagement apparatus.

Figure 3:
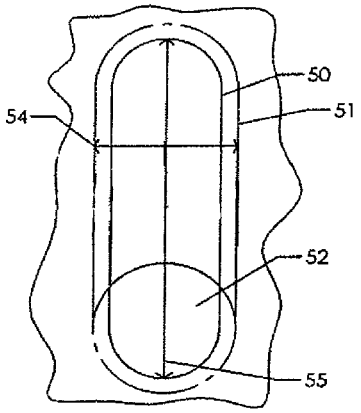
FIG. 3 is a side view of an elongated slot of the cage housing of previous attempts.

FIG. 3 is a side view of an elongated slot 50 of the cage housing of previous attempts such that the length 55 is greater than the width 54. The length 55 is substantially parallel to the longitudinal axis of the cage housing. The rolling element 52 is allowed to travel the full length of the slot 50 while being retained between the cage housing and the member containing the inclined ramps 59. The width 54 is at least about or greater than the diameter of the rolling member 52.

Figure 4:
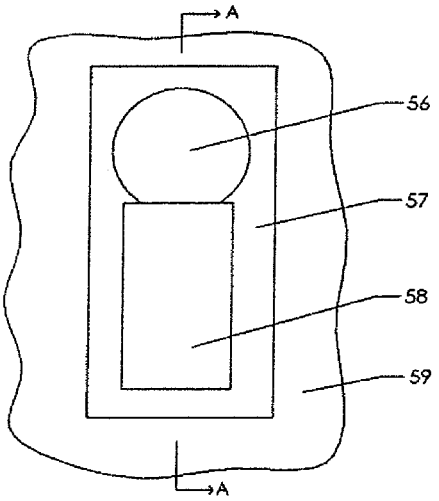
FIG. 4 is a side view of an inclined ramp of previous attempts.

FIG. 4 is a side view of an inclined ramp 58 of previous attempts illustrating the deepened portion 56 of the member containing the inclined surfaces 59. Also illustrated is the insert 57 containing the inclined ramp which is affixed to member 59 via press fit, interference fit, adhesive, threaded fasteners, etc.

Figure 5:
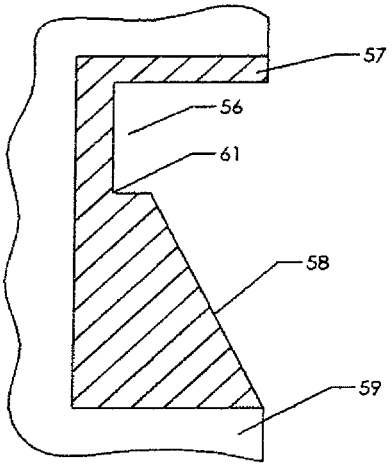
FIG. 5 is a sectioned view of FIG. 4 through A-A.

FIG. 5 is a sectioned view of FIG. 4 through A-A illustrating the insert 57 containing the inclined ramp 58. Also shown are the square corners 61 created by the deepened portion 56.

FIG. 6 is a detailed close-up sectioned view of an internal gripping tubular engagement apparatus showing the ramped surfaces 8 of the inner member 7 that the rolling supports with or without a central spindle 9 ascend and descend. The view also shows the openings 4 through which the rolling supports with or without a central spindle 9 can partially protrude through and engage the inner surface of a tubular. Also shown are the smooth generous radii 71 and 72. These radii maximize the cross sectional area of the load carrying member 7. Bore 20 permits fluid transmission through the gripping device.

Figure 7:
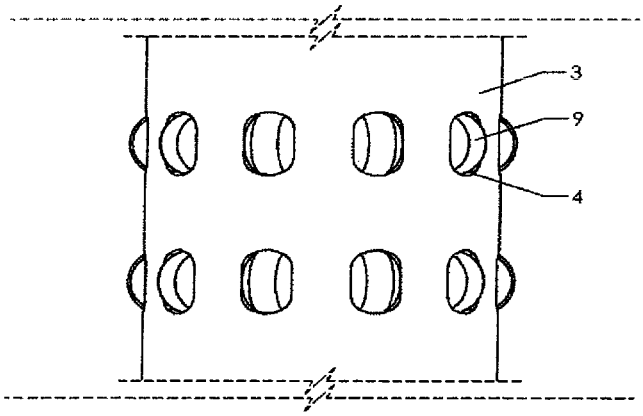
FIG. 7 is a front elevation view of one embodiment of a rolling supports with or without a central spindle and inclined surfaces assembly for gripping the internal surface of a tubular OCTG.

FIG. 7 is an elevation view of FIG. 6 showing the rolling supports with or without a central spindle 9 protruding through openings 4 in cage housing 3. The rolling supports with or without a central spindle 9 are retracted until their outermost surfaces only partially protrude from outer surface of cage housing 3 prior to entering a tubular. This very slight protrusion allows the rolling supports 9 to act as bearings as the gripping device is entering or exiting a tubular. It can be seen that the openings 4 closely match the profile of rolling supports 9. This minimizes the potential for debris entering the assembly. It can also be seen from FIG. 6 and FIG. 7 that the rolling supports 9 can only roll up or down the inclined surfaces 8 in one direction, thus are restricted from rotating in a transverse direction relative to the central axis of the gripping device. This restriction from rotation aids in the transmission or torque from the gripping device to the tubular.

Figure 8:
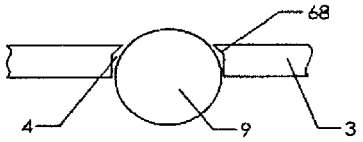
FIG. 8 is a sectioned view of one embodiment of a rolling support partially protruded from the cage housing.

FIG. 8 is a sectioned view of one embodiment of a rolling support without a central spindle 9 partially protruded from an opening 4 in the cage housing 3. The rolling support 9 is retained within the assembly via shoulders 68. The rolling support 9 is only allowed to move radially relative to cage housing 3. This makes the movement of the rolling support 9 very responsive to movement of the cage housing 3.

Figure 9:
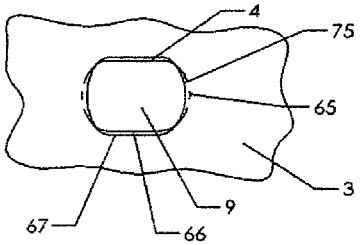
FIG. 9 is a side view of one embodiment of a cage housing with a rolling support mounted within an opening.

FIG. 9 is a side view of one embodiment of the cage housing 3 of FIG. 8 with a rolling support without a central spindle 9 mounted within an opening 4. The opening 4 has substantially flat sides 67 and substantially curved ends 75. The flat sides 67 are aligned with the longitudinal axis of cage housing 3. The sides 66 of the rolling support without central spindles 9 are allowed to protrude through opening 4 and are close in proximity to the sides of the opening 67. The curved portion 65 of the rolling support 9 constrains the rolling support within the assembly via shoulders 68.

Figure 10:
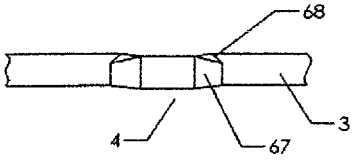
FIG. 10 is a sectioned view of one embodiment of a cage housing with the rolling support removed for clarity.

FIG. 10 is a sectioned view of one embodiment of an opening 4 in the cage housing 3 with the rolling support removed for clarity. The rolling support without a central spindle 9 is retained within the assembly via features 68. The flat 67 of opening 4 provides a large surface area for torque transmission. The contact between the flat surface 67 of the cage housing 3 and the flat surface 66 of the rolling support 9 prevents the rolling support from rotating within the pocket or inclined surface 8 of member 7. This aids in the transmission of torque to the tubular.

Figure 11:
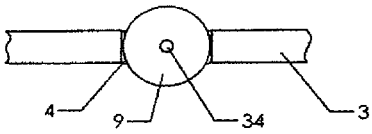
FIG. 11 is a sectioned view of a second embodiment of a rolling support partially protruded from the cage housing.

FIG. 11 is a sectioned view of a second embodiment of a rolling support 9 with a central spindle 34 partially protruded from an opening 4 in the cage housing 3. The rolling support 9 is retained within the assembly via spindle 34. The rolling support 9 is only allowed to move radially relative to cage housing 3. This makes the movement of the rolling support 9 very responsive to movement of the cage housing 3.

Figure 12:
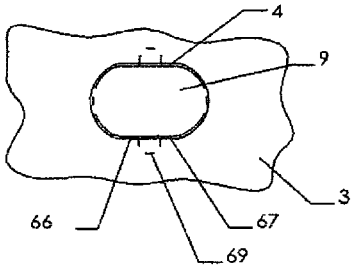
FIG. 12 is a side view of a second embodiment of a cage housing with a rolling support mounted within an opening.

FIG. 12 is a side view of a second embodiment of the cage housing 3 of FIG. 11 with a rolling support with a central spindle 9 mounted within an opening 4. The opening 4 has substantially flat sides 67 and substantially curved ends 75. The flat sides 67 are aligned with the longitudinal axis of cage housing 3. The sides 66 of the rolling support with central spindles 9 are allowed to protrude through opening 4 and are close in proximity to the sides of the opening 67. Undercut feature 69 of the cage housing 3 retains rolling support with central spindles 9 within the assembly via spindle 34.

Figure 13:
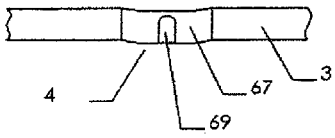
FIG. 13 is a sectioned view of a second embodiment of a cage housing with the rolling support removed for clarity.

FIG. 13 is a sectioned view of a second embodiment of an opening 4 in the cage housing 3 with the rolling support 9 removed for clarity. The rolling support with a central spindle 9 is retained within the assembly via feature 69. The flat 67 of opening 4 provides a large surface area for torque transmission. The contact between the flat surface 67 of the cage housing 3 and the flat surface 66 of the rolling support 9 prevents the rolling support from rotating within the pocket or inclined surface 8 of member 7. This aids in the transmission of torque to the tubular.

Figure 14:
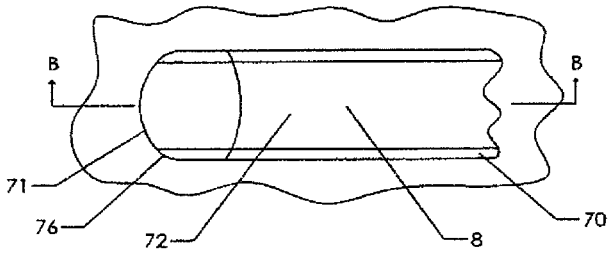
FIG. 14 is a side view of one embodiment of an inclined surface.

FIG. 14 is a side view of one embodiment of an inclined surface 8 with a radius 72 on the bottom surface and a radius 70 along the sides of the incline which may or may not be the same as radius 72. There is also a radius 71 near the deep portion at the end of the incline along with another radius 76 at the corners. All of these aforementioned radii can be the same or different depending on the profile of the rolling support 9. These radii will be the same as or similar to those of the rolling support 9. In order to maximize the cross sectional area of the member 7 containing the inclined surfaces 8, the radii are sized as large as the application or rolling support 9 profile will permit. This eliminates all sharp corners and edges thus greatly reducing stress concentrations and thereby increasing load carrying capacities dramatically.

Figure 15:
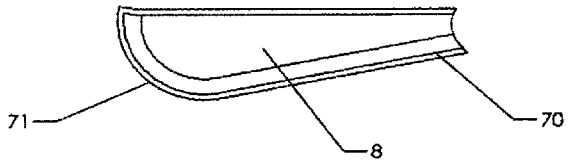
FIG. 15 is a sectioned view of FIG. 14 through B-B.

FIG. 15 is a sectioned view of the inclined surface 8 of member 7 through B-B again illustrating the large radii 71 and the radii 70 along the sides of the inclined surface. In one embodiment of the invention, the inclined surface would be at an angle between 5 degrees and 19 degrees relative to the central axis. In another embodiment of the invention, the inclined surface would be at an angle between 6 degrees and 13 degrees relative to the central axis. In yet another embodiment of the invention, the inclined surface would be at an angle between 9 degrees and 11 degrees relative to the central axis.

Figure 16:
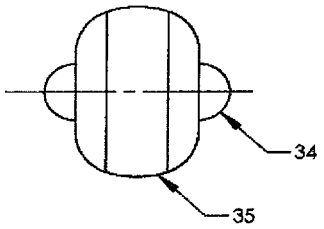
FIG. 16 is a front elevation view of one embodiment of a rolling support with a spindle through its central axis.

FIG. 16 is a front elevation view of one embodiment of a rolling support with a spindle 34 through its central axis and curved or arced profile 35 on its outermost surface. The radius of arc 35 can be varied to accommodate differing applications. This radius can match that of the tubular or can be a much smaller radius creating a sharper edge. This surface may also include tooth profiles, grooves, grit coatings or other means to increase the grip onto the tubular. It may also include multiple radii or a radius that varies or changes across the profile. The central spindle 34 is shown here as a round or rounded feature but can be substantially cylindrical or various other shapes.

Figure 17:
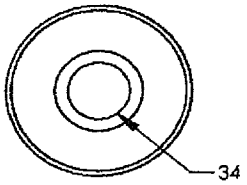
FIG. 17 is a side elevation view of the rolling support of FIG. 16 with a spindle through its central axis.

FIG. 17 is a side elevation view of the rolling support of FIG. 16 with a spindle 34 through its central axis.

Figure 18:
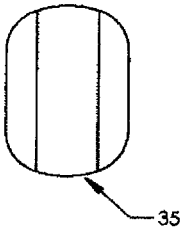
FIG. 18 is a front elevation view of one embodiment of a rolling support with no spindle.

FIG. 18 is a front elevation view of one embodiment of a rolling support with no spindle.

Figure 19:
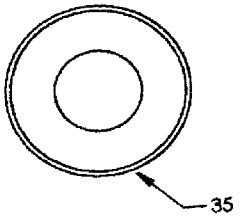
FIG. 19 is a side elevation view of the rolling support of FIG. 18 with no spindle.

FIG. 19 is a side elevation view of the rolling support of FIG. 18 with no spindle.

Figure 20:
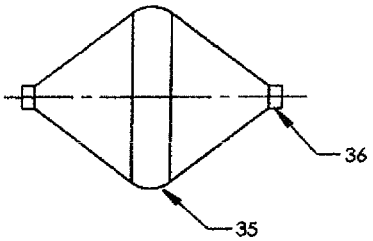
FIG. 20 is a front elevation view of a second embodiment of a rolling support with a spindle through its central axis.

FIG. 20 is a front elevation view of a second embodiment of a rolling support with a spindle 36 through its central axis.

Figure 21:
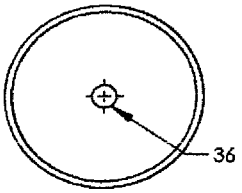
FIG. 21 is a side elevation view of the rolling support of FIG. 20 with a spindle through its central axis.

FIG. 21 is a side elevation view of the rolling support of FIG. 20 with a spindle 36 through its central axis.

Figure 22:
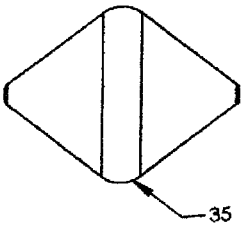
FIG. 22 is a front elevation view of a second embodiment of a rolling support with no spindle.

FIG. 22 is a front elevation view of a second embodiment of a rolling support with no spindle.

Figure 23:
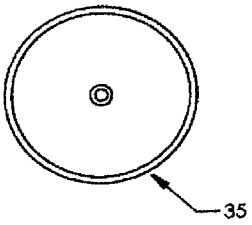
FIG. 23 is a side elevation view of the rolling support of FIG. 22 with no spindle.

FIG. 23 is a side elevation view of the rolling support of FIG. 22 with no spindle.

Figure 24:
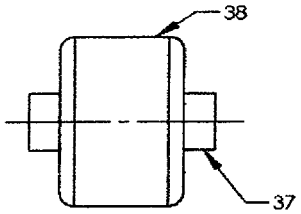
FIG. 24 is a front elevation view of a third embodiment of a rolling support with a spindle through its central axis.

FIG. 24 is a front elevation view of a third embodiment of a rolling support with a spindle 37 through its central axis and a substantially flat surface 38 on its outermost surface.

Figure 25:
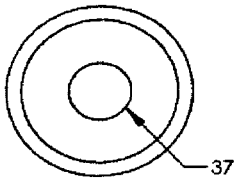
FIG. 25 is a side elevation view of the rolling support of FIG. 24 with a spindle through its central axis.

FIG. 25 is a side elevation view of the rolling support of FIG. 24 with a spindle 37 through its central axis.

Figure 26:
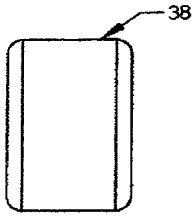
FIG. 26 is a front elevation view of a third embodiment of a rolling support with no spindle.

FIG. 26 is a front elevation view of a third embodiment of a rolling support with no spindle.

Figure 27:
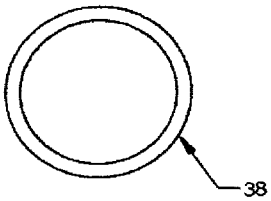
FIG. 27 is a side elevation view of the rolling support of FIG. 26 with no spindle.

FIG. 27 is a side elevation view of the rolling support of FIG. 26 with no spindle.

Figure 28:
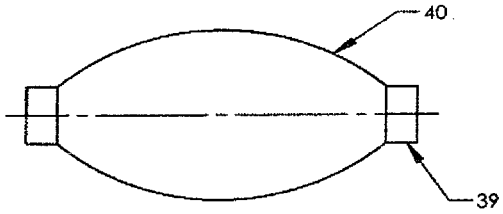
FIG. 28 is a front elevation view of a fourth embodiment of a rolling support with a spindle through its central axis

FIG. 28 is a front elevation view of a fourth embodiment of a rolling support with a spindle 39 through its central axis and curved outermost surface 40.

Figure 29:
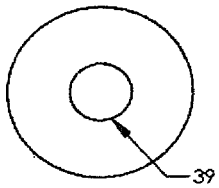
FIG. 29 is a side elevation view of the rolling support of FIG. 28 with a spindle through its central axis.

FIG. 29 is a side elevation view of the rolling support of FIG. 28 with a spindle 39 through its central axis.

Figure 30:
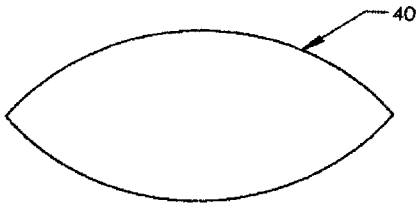
FIG. 30 is a front elevation view of a fourth embodiment of a rolling support with no spindle.

FIG. 30 is a front elevation view of a fourth embodiment of a rolling support with no spindle.

Figure 31:
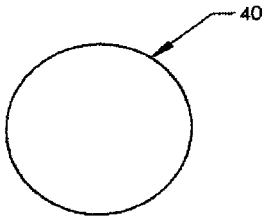
FIG. 31 is a side elevation view of the rolling support of FIG. 30 with no spindle.

FIG. 31 is a side elevation view of the rolling support of FIG. 30 with no spindle.

Figure 32:
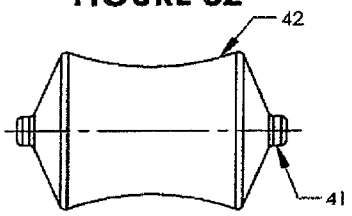
FIG. 32 is a front elevation view of a fifth embodiment of a rolling support with a spindle through its central axis.

FIG. 32 is a front elevation view of a fifth embodiment of a rolling support with a spindle 41 through its central axis and a concave profile 42 on its outermost surface. This outer profile 42 may or may not have the same radius as the tubular to be gripped. For example, in exterior gripping applications, the profile 42 may match that of the outer diameter of the tubular.

Figure 33:
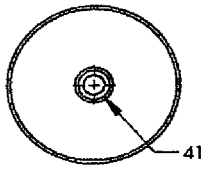
FIG. 33 is a side elevation view of the rolling support of FIG. 32 with a spindle through its central axis.

FIG. 33 is a side elevation view of the rolling support of FIG. 32 with a spindle 41 through its central axis.

Figure 34:
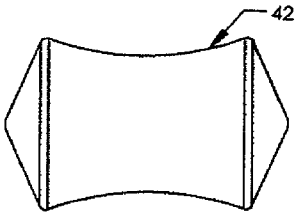
FIG. 34 is a front elevation view of a fifth embodiment of a rolling support with no spindle.

FIG. 34 is a front elevation view of a fifth embodiment of a rolling support with no spindle.

Figure 35:
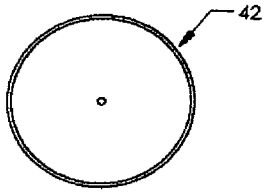
FIG. 35 is a side elevation view of the rolling support of FIG. 34 with no spindle.

FIG. 35 is a side elevation view of the rolling support of FIG. 34 with no spindle.

Figure 36:
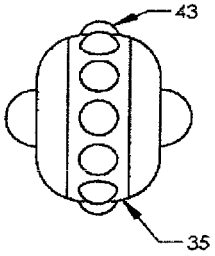
FIG. 36 is a front elevation view of a sixth embodiment of a rolling support with nodules on its outermost surface.

FIG. 36 is a front elevation view of a sixth embodiment of a rolling support with nodules 43 on its outermost surface 35. Shown is a single row of mostly spherical nodules but these can be of any shape, size, number, and orientation. These can resemble hemispheres, cubes, pyramids, cylinders, etc. These nodules can also be coated with a grit or abrasive material or can be of a rough or textured surface.

Figure 37:
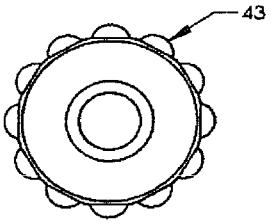
FIG. 37 is a side elevation view of the rolling support of FIG. 36 with nodules on its outermost surface.

FIG. 37 is a side elevation view of rolling support of FIG. 36 with nodules 43.

Figure 38:
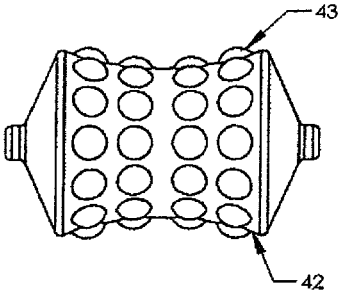
FIG. 38 is a front elevation view of a seventh embodiment of a rolling on its outermost surface with several rows of nodules on outermost surface.

FIG. 38 is a front elevation view of a seventh embodiment of a rolling support with several rows of nodules 43 on outermost surface 42. Shown are four rows of mostly spherical nodules but these can be of any shape, size, number, and orientation.

Figure 39:
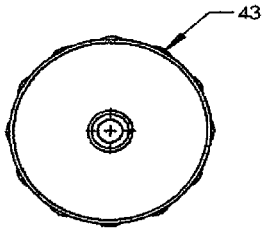
FIG. 39 is a side elevation view of the rolling support of FIG. 38 with nodules on its outermost surface.

FIG. 39 is a side elevation view of the rolling support of FIG. 38 with nodules 43.

Figure 40:
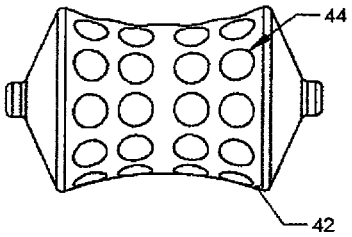
FIG. 40 is a front elevation view of an eighth embodiment of a rolling support with several rows of dimples or divots on its outermost surface.

FIG. 40 is a front elevation view of a seventh embodiment of a rolling support with several rows of dimples or divots 44 on outermost surface 42. Shown are four rows of mostly spherical dimples but these can be of any shape, size, number, and orientation.

Figure 41:
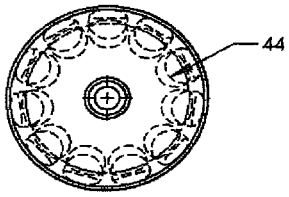
FIG. 41 is a side elevation view of the rolling support of FIG. 40 with dimples or divots.

FIG. 41 is a side elevation view of the rolling support of FIG. 40 with dimples 44.

Figure 42:
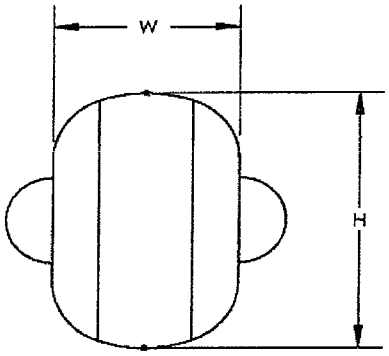
FIG. 42 is a front elevation view of a rolling support illustrating the aspect ratio which is defined by the width (W)/height (H).

FIG. 42 is a front elevation view of a rolling support illustrating the aspect ratio which is defined by the width (W)/height (H). These variables can be modified to suit varying applications. The number of balls which can be physically placed around the circumference of a given diameter shaft is dependent on the width of the rolling supports with or without a central spindle. Thus, this width can be adjusted to increase or decrease the concentration of rolling supports with or without a central spindle on a shaft per unit length. The height of the rolling supports with or without a central spindle can also be adjusted to maximize the gripping range to accommodate a larger range of tubular OD's or ID's. This aspect ratio can be modified to suit regardless of the embodiment of the rolling support. This feature of the rolling supports provides enormous mechanical advantages over conventional ball and taper technology.

Figures 43, 44, 45, 46:
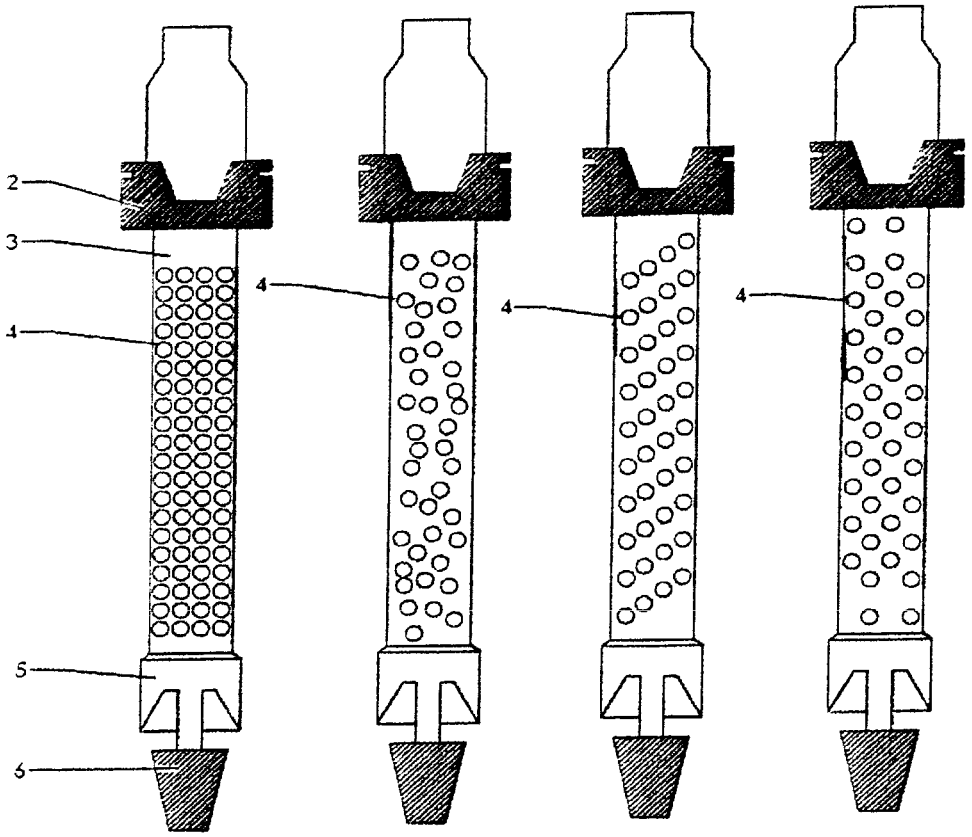
FIG. 43 shows an elevation view of a tubular engagement apparatus in accordance with one embodiment of the present invention with rolling supports with or without a central spindle and their respective openings mounted in circumferential and longitudinal rows thereon.
FIG. 44 shows an elevation view of a tubular engagement apparatus in accordance with a second embodiment of the present invention with a plurality of rolling supports with or without a central spindle and their respective openings mounted randomly thereon.
FIG. 45 shows an elevation view of a tubular engagement apparatus in accordance with a third embodiment of the present invention with a plurality of rolling supports with or without a central spindle and their respective openings mounted diagonally thereon.
FIG. 46 shows an elevation view of a tubular engagement apparatus in accordance with a fourth embodiment of the present invention with a plurality of rolling supports with or without a central spindle and their respective openings mounted in longitudinal rows whereby every other row is staggered either up or down thereon.

FIG. 43 shows an internal tubular running assembly with a series of longitudinally displaced rows of openings 4, a lower packer cup 5, and a guide shoe 6 to facilitate stabbing of the tubular running assembly into a tubular and a hydraulic or pneumatic actuator 2 for energizing the cage 3 in respect to the inner member 7. The size, quantity, and shape or profile of the rolling supports with or without a central spindle 9 can be modified to suit varying applications, types of tubulars, total string weight, and or length of the tubulars.

FIG. 44 shows an internal tubular running assembly with a series of randomly displaced rows of openings 4, a lower packer cup 5, and a guide shoe 6 to facilitate stabbing of the tubular running assembly into a tubular and a hydraulic or pneumatic actuator 2 for energizing the cage 3 in respect to the inner member 7. The size, quantity, and shape or profile of the rolling supports with or without a central spindle 9 can be modified to suit varying applications, types of tubulars, total string weight, and or length of the tubulars.

FIG. 45 shows an internal tubular running assembly with a series of diagonally displaced rows of openings 4, a lower packer cup 5, and a guide shoe 6 to facilitate stabbing of the tubular running assembly into a tubular and a hydraulic or pneumatic actuator 2 for energizing the cage 3 in respect to the inner member 7. The size, quantity, and shape or profile of the rolling supports with or without a central spindle 9 can be modified to suit varying applications, types of tubulars, total string weight, and or length of the tubulars.

FIG. 46 shows an internal tubular running assembly with a series of staggered displaced rows of openings 4, a lower packer cup 5, and a guide shoe 6 to facilitate stabbing of the tubular running assembly into a tubular and a hydraulic or pneumatic actuator 2 for energizing the cage 3 in respect to the inner member 7. The size, quantity, and shape or profile of the rolling supports with or without a central spindle 9 can be modified to suit varying applications, types of tubulars, total string weight, and or length of the tubulars.

Figure 47:
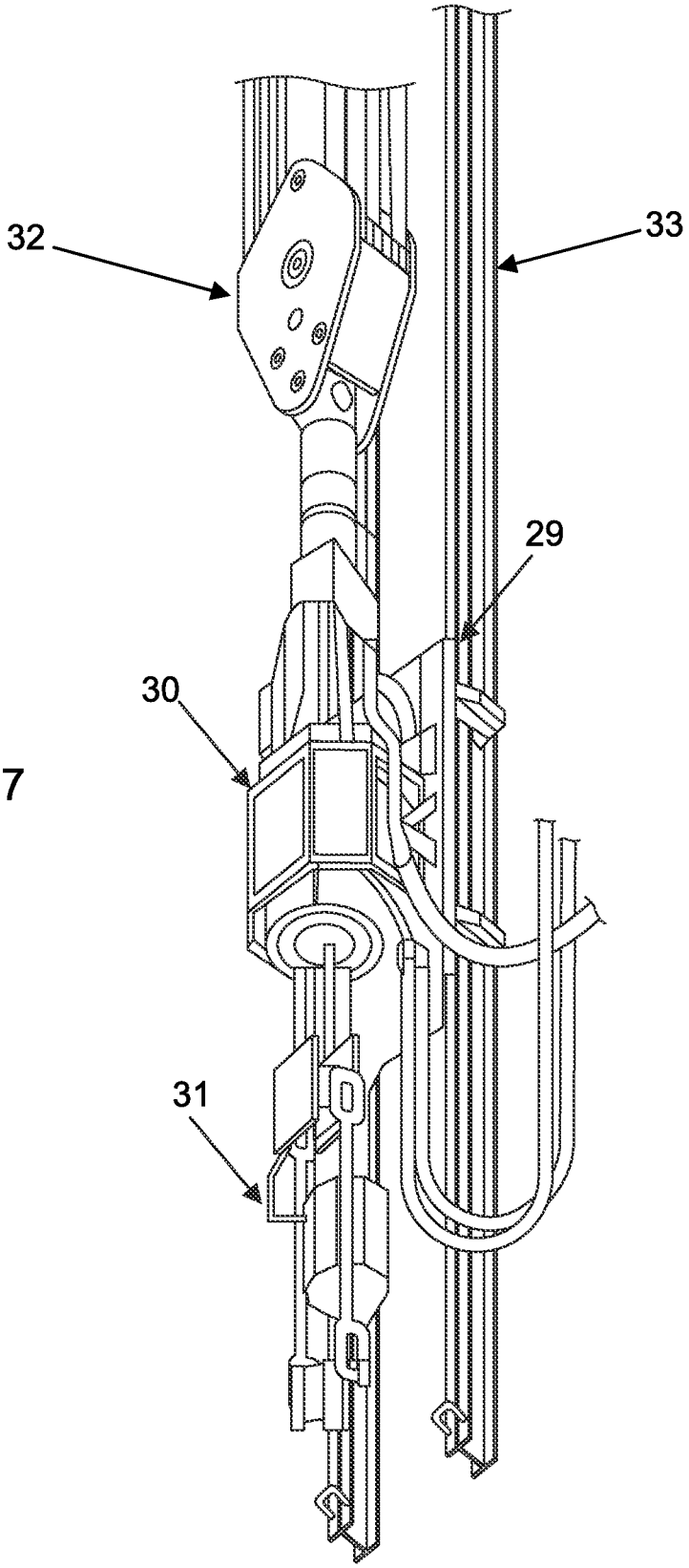
FIG. 47 shows a pictorial view of a top drive assembly defining how the tubular running assembly and elevator assembly of the present invention may be installed. It should be noted that manufacturers of top drive systems are many and each may have their own technical differences in configuration of moving parts. However, it is generally found that they are all capable of executing the same tasks of providing a means for connection to a drilling string or cross-over sub, providing a means to lift and or lower the OCTG tubular or string, providing a means for rotation in both forward and reverse directions, and the ability to apply torque in varying degrees of power.

FIG. 47 shows a pictorial view of a top drive assembly defining how the make-up assembly and elevator assembly of the present invention may be installed. In this depiction, a top drive 30 on a frame 29 rides on a track 33, being raised or lowered by a block 32. A typical toothed grapple apparatus 31 is shown attached to the top drive 30.

Figure 48:
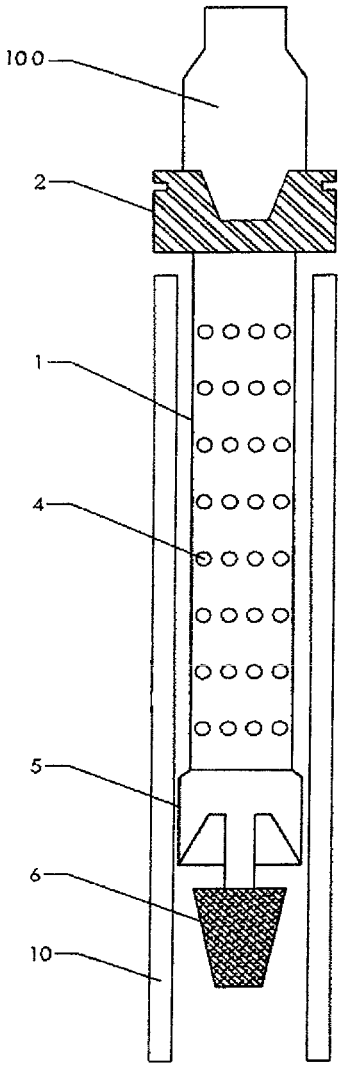
FIG. 48 shows an axial view of a tubular running assembly in accordance with one embodiment of the present invention shown in FIG. 1 installed inside a tubular joint OCTG.

FIG. 48 shows an embodiment of the present invention installed inside a tubular OCTG 10 prior to the rolling supports with or without a central spindle 9 being energized. It can be clearly seen that the hydraulic or pneumatic actuator 2 or the drill pipe crossover joint 1 which connects the make-up assembly to the top drive or hook assembly does not engage the tubular OCTG 10.

Figure 49:
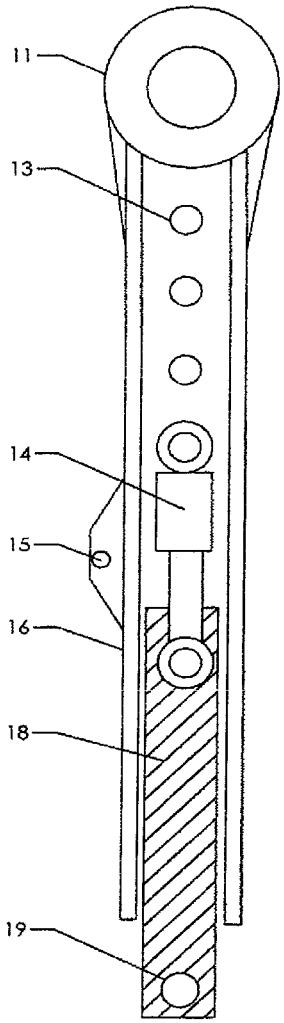
FIG. 49 shows a sectional view through the elevator links of the elevator assembly in accordance with one embodiment of the present invention showing the multi-stage hydraulic ram installed inside the link along with the adjustment holes used to further extend the length of the links for varying rig applications.

FIG. 49 shows a sectional cross view of the main elevator link body 16 showing the inner hydraulic or pneumatic multi-stage cylinder 14 used to extend or retract the lower link body 18 in relation to the corresponding link body 16. It also displays the adjustable mounting points 13 contained in the link body 16 such that the total length of the link body 16 may be set prior to extension or retraction. This will allow for a greater flexibility of total length, which will compensate for the variable distances between well centers and V-doors on drilling rigs. The figure also shows the mounting point 15 for the link tilt mounted on the outside of the link main body 16. The figure also shows the attachment points 11 to facilitate mounting the main link bodies 16 onto the hydraulic actuator 2. Also shown is the lower link extendable portion 18 of the link assembly with the elevator attachment point 19 near its end.

Figure 50:
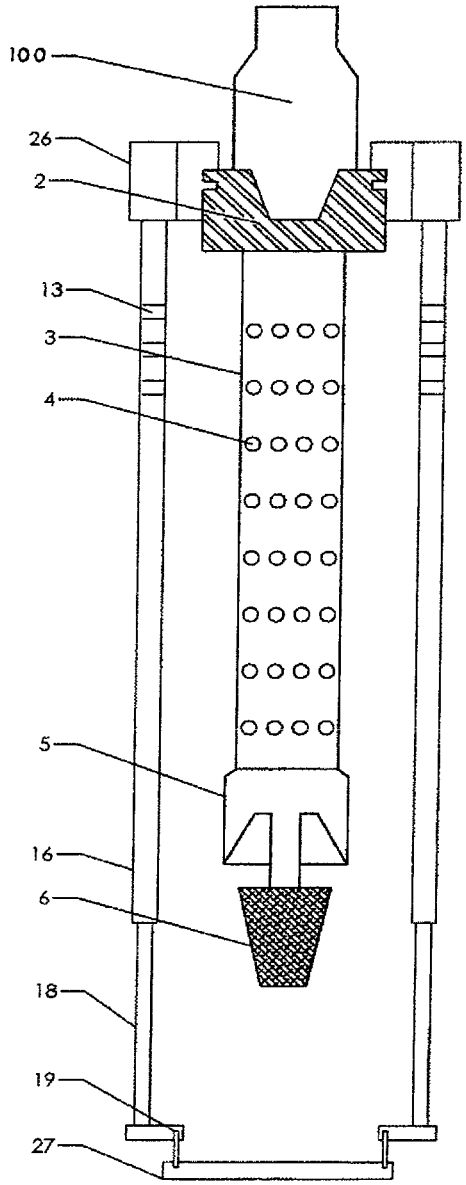
FIG. 50 shows an elevation view of the tubular running assembly and elevator assembly in accordance with one embodiment of the present invention showing how it would be rigged up for connection to a top-drive assembly.

FIG. 50 shows a vertical view of the tubular running assembly and elevator assembly detailing one configuration for attachment to a top drive assembly via the drill pipe crossover 1, the hydraulic actuator 2, the outer cage 3, rolling support openings 4, packer cup 5, lower guide shoe 6, link lower body 18, transfer elevator attachment points 19, and the transfer elevator 27.

Figure 51:
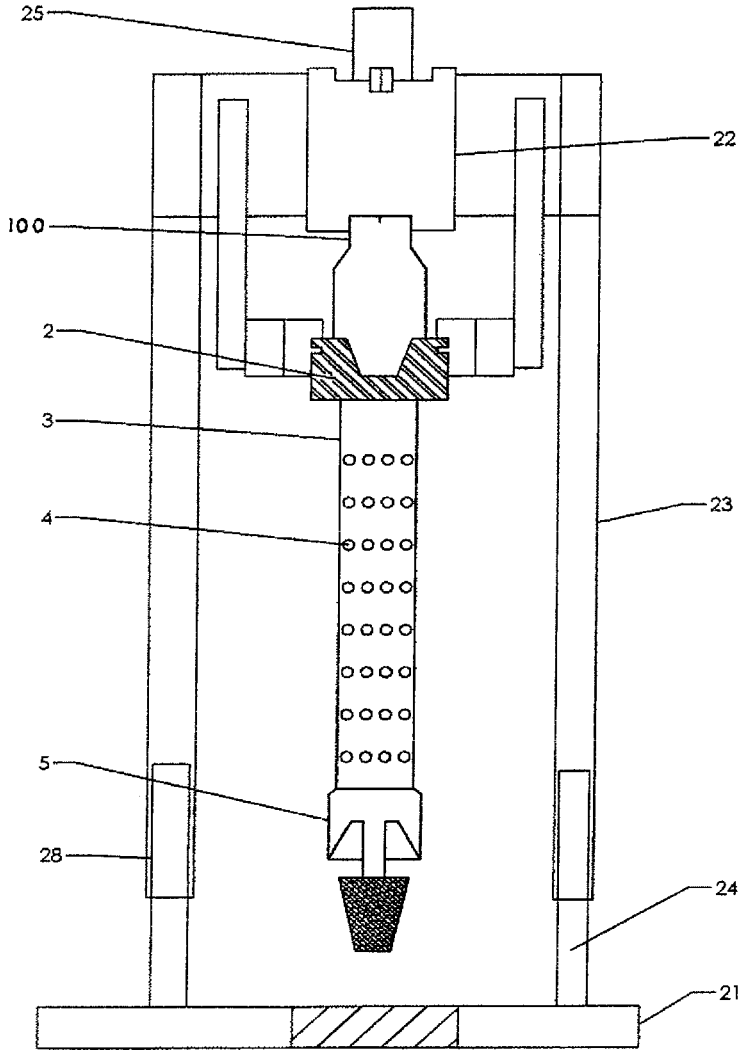
FIG. 51 shows an elevation view of a tubular running assembly in accordance with one embodiment of the present invention showing how it would be rigged up to a power swivel and hydraulic or pneumatically controlled torque frame.

FIG. 51 shows an elevation view of tubular running assembly installed into a frame 23 installed onto a base plate 21 with telescoping members 24 allowing the tubular running assembly to be raised and lowered. In this arrangement the tubular running assembly would be typically installed onto a wellhead assembly where no rig, derrick or top drive assembly was present. It could also be installed on a hydraulic workover unit or snubbing twit utilizing a power swivel or rotary drive assembly 22. The frame 23 is variable in height and contains multi-stage hydraulic or pneumatic cylinders 28 to raise and lower the apparatus as well as track forwards and backwards relative to the tubular OCTG. Member 25 is an attachment member to the powered rotational device.

It will be apparent that many other changes may be made to the illustrative embodiments, while falling within the scope of the invention and it is intended that all such changes can be covered by the claims appended hereto.

Although the disclosed embodiments have been described in detail, it should be understood that various changes, substitutions and alterations can be made to the embodiments without departing from their spirit and scope. Other technical advantages of the present invention will be readily apparent to one skilled in the art from the following figures, drawings, descriptions and claims.

We claim:

1. A tubular engagement apparatus comprising:

a first member comprising a plurality of indentations disposed in a surface of the first member, each indentation comprising an inclined surface angled relative to a longitudinal axis of the first member;

a second member concentrically disposed relative to the first member, the second member comprising a plurality of openings, wherein a respective length of each opening is substantially aligned with the longitudinal axis of the first member; and a plurality of non-spherical rolling supports, each support disposed within an indentation of the first member, and each support corresponding to an opening in the second member, wherein each non-spherical rolling support comprises an outermost surface configured to engage the inclined surface of the indentation of the first member, and a central spindle extending from either side of the support perpendicular to the longitudinal axis of the first member, and wherein movement of the second member relative to the first member urges the rolling supports along the inclined surfaces of indentations of the first member.

2. The apparatus of claim 1, further comprising an actuator configured to move the second member relative to the first member.

3. The apparatus of claim 1, wherein the first member engages the second member in a manner allowing longitudinal relative movement but disallowing rotational movement therebetween.

4. The apparatus of claim 1, wherein the outermost surface of the rolling support comprises a curved profile.

5. The apparatus of claim 1, wherein the outermost surface of the rolling support comprises a substantially flat profile.

6. The apparatus of claim 1, wherein the outermost surface of the rolling support comprises one or more nodules.

7. The apparatus of claim 1, wherein the central spindle is configured to engage a notch formed in a surface of the second member.

8. The apparatus of claim 1, wherein each of the plurality of openings comprises substantially flat sides along the respective length.

9. The apparatus of claim 1, wherein the non-spherical rolling supports are configured to engage an interior surface or exterior surface of a tubular.

10. The apparatus of claim 1, wherein each inclined surface extends longitudinally at an angle relative to the longitudinal axis between approximately 5 degrees and 19 degrees.

11. The apparatus of claim 1, wherein a respective length of each opening is substantially equal to a diameter of the corresponding non-spherical rolling support.

12. A system for handling tubular members, the system comprising:

an elevator assembly configured to position a tubular member above a rotary table in the drill floor; and a tubular running assembly coupled with a top drive assembly and configured to engage the tubular member, the tubular running assembly comprising:

an inner body comprising a plurality of indentations disposed in an outer surface of the inner body, each indentation comprising an inclined surface angled relative to a longitudinal axis of the inner body;

a cage member concentrically disposed relative to the inner body, the cage member comprising a plurality of openings, wherein a respective length of each opening is substantially aligned with the longitudinal axis of the inner body; and a plurality of non-spherical rolling supports, each support disposed within an indentation of the inner body, and each support corresponding to an opening in the cage member, wherein each non-spherical rolling support comprises an outermost surface configured to engage the inclined surface of the indentation of the inner body, and a central spindle extending from either side of the support perpendicular to the longitudinal axis of the inner body, and wherein movement of the cage member relative to the inner body urges the rolling supports along the inclined surfaces of indentations of the inner body.

13. The apparatus of claim 12, further comprising an actuator configured to move the cage member relative to the inner body.

14. The apparatus of claim 12, wherein each of the plurality of openings comprises substantially flat sides along the respective length.

15. The apparatus of claim 12, wherein each inclined surface extends longitudinally at an angle relative to the longitudinal axis between approximately 5 degrees and 19 degrees.

* * * * *